US009409672B2

(12) United States Patent
Kullberg

(10) Patent No.: US 9,409,672 B2
(45) Date of Patent: Aug. 9, 2016

(54) CLOSURE ON A RECTANGULAR CONTAINER

(76) Inventor: Wilhelm Kullberg, Wood Dale, IL (US)

( * ) Notice: Subject to any disclaimer, the term of this patent is extended or adjusted under 35 U.S.C. 154(b) by 465 days.

(21) Appl. No.: 13/573,160

(22) Filed: Aug. 24, 2012

(65) Prior Publication Data

US 2013/0098978 A1 Apr. 25, 2013

(51) Int. Cl.
*B65D 5/06* (2006.01)
*B65D 5/74* (2006.01)

(52) U.S. Cl.
CPC ..... *B65D 5/742* (2013.01); *B65D 5/062* (2013.01); *B65D 5/741* (2013.01)

(58) Field of Classification Search
CPC ..... B65D 5/062; B65D 5/741; B65D 5/742
USPC ..... 229/125.42, 137, 208, 212, 217, 219, 229/245
See application file for complete search history.

(56) References Cited

U.S. PATENT DOCUMENTS 2,300,703 A * 11/1942 Carlo ..... 229/217
2,364,364 A * 12/1944 Hultin ..... 229/219
2,695,745 A * 11/1954 Dixon ..... 229/249
2,861,732 A * 11/1958 Parker ..... 229/217
2,928,579 A * 3/1960 Graybill ..... 229/217
3,003,673 A * 10/1961 Clark et al. ..... 229/217
3,059,826 A * 10/1962 Harms ..... 229/217
3,081,927 A * 3/1963 Hayhurst ..... 229/125.37
3,107,038 A * 10/1963 Kuchenbecker ..... 229/217
3,118,586 A * 1/1964 Kelly ..... 229/137
3,147,904 A * 9/1964 Larson ..... 229/137
3,341,349 A * 9/1967 Feeney et al. ..... 229/137
3,724,741 A * 4/1973 Jacobson ..... 229/208
3,892,347 A * 7/1975 Egleston ..... 229/217
4,180,167 A * 12/1979 Leavitt et al. ..... 229/218
4,657,143 A * 4/1987 Forbes, Jr. ..... 229/212
5,080,233 A * 1/1992 Wyberg ..... 229/208
5,335,847 A * 8/1994 Lisiecki ..... 229/137
5,685,479 A * 11/1997 Weber-Caspers ..... 229/125.42
6,158,654 A * 12/2000 Zimmermann ..... 229/217
6,318,626 B1 * 11/2001 St. Pierre et al. ..... 229/117.3
2005/0274782 A1 * 12/2005 Petrelli et al. ..... 229/217

FOREIGN PATENT DOCUMENTS

EP 820936 A3 * 1/1998 ..... B65D 5/742

* cited by examiner

*Primary Examiner* — Gary Elkins
(74) *Attorney, Agent, or Firm* — Bishop Diehl & Lee, Ltd.

(57) ABSTRACT

A closure on a rectangular container with a square or rectangular cross section with the closure easily opened into a pour spout. The container closure can be resealed. The new container provides a consumer friendly container design, reduced materials consumption, high efficiency from production capacity and distribution view points.

3 Claims, 1 Drawing Sheet

CLOSURE ON A RECTANGULAR CONTAINER

BACKGROUND OF THE INVENTION

The present invention is a closure on a rectangular container for pourable consumer products wherein the closure is folded and heat sealed in a way that the closure easily can be opened into a pour spout for pouring out the content under full control. By folding back the slightly larger triangular pour spout area than the triangular closure opening, the closure is resealed air tight. The new container design provides; consumer friendly usage, reduced materials consumption, high efficiency from production capacity and distribution view points. State of the art containers for liquid products generally have an injection molded pour and cap re-close attachment made of polymer material heat sealed (for some container types comprising 4 injection molded parts) onto the container top panel in order to improve consumer acceptance.

The present invention is providing a controlled tearing path, between an in depth scoring line (beyond container food content) and an 180° folded Polyethylene coated paper board edge of two superimposed and heat sealed Polyethylene (PE) coated paper board panels.

In first index station the rectangular paper board tube structure is pushed onto an indexing mandrel, (rotating with eight mandrels) and in the second index station a film strip is cut off and partially sealed inside 0ne of the paper board tube structures longer mid closure edges. Third and fourth index stations are heat activated by a nozzle/manifold moving over the sealing area with a hot air stream and having multiple specific sealing patterns inside and outside rectangular paper board sleeve sealing area until heat activation finished. Between fourth and fifth index station, the two rectangular paper board tube structures longer panels (third and fourth fades) are pre-folded towards the cartons center (by two rotating folders), one panel including the film strip before the other panel and guided under two stationary guides before reaching the final fold configuration under a compression plate in fifth index station, having different levels (a pattern) with at least on integrated spring loaded element, for finally sealing the closure air tight & liquid proof. Sixth and eight index station are blind stations. In index station seven, the paper board structure with the sealed carton closure is pushed into an indexing pocket belt where the cartons later are filled (upside down) and finally the carton bottom is sealed. Both sides polyethylene (PE) coated paper board is normally used, but also one side polyethylene (PE) coated paper board could be used in combination with a hot melt polymer liquid sealant. When using a multi-polymer-laminate including aluminum foil, induction sealing could eventually be considered. Ultra Sonic sealing is a third option, that eventually also could be considered. By using plain paper board without polymer coating, hot melt is used for sealing the entire carton. For an aseptic carton version, skiving and hemming of the $5^{th}$ panel is required.

U.S. Pat. No. 3,145,899 provide a container with a permanent film element sealed into the paper board container bottom which is not intended to be opened, but providing a permanent bottom seal of the container. In order to push a container with a rectangular cross section onto a mandrel in a production machine, a tolerance is needed between the container and the mandrel cross sections; otherwise one of the panel walls of a container will be destructed when pushing the container onto the mandrel. Heat sealing four folded down film element sides to four container panel walls, require that the cross section inside the container and the mandrel are more or less identical, otherwise the film element will be too small and the film element will be under tension from the large container cross section and come loose, resulting in leaking containers.

According to European Patent #0511358 B1, a Polyethylene (PE) film element is placed onto a mandrel surface with the objective of folding a container over the mandrel and heat seal the film element inside the container closure in a way that the Polyethylene (PE) film breaks along two of the container closures straight paper board folding lines when opening the container. A major obstacle with this container closure design is that a minor liquid channel in the film element edge area where the paper board is folded 180° could not be heat sealed liquid proof. Substantial engineering capacity over a very long period of time could not resolve this problem and it was decided not to commercialize this container design. Distribution tests furthermore proved that the Polyethylene (PE) film does not withhold the tension on the film element throughout the entire distribution route and the film element fractures, resulting in leaking containers. Several stronger multi-laminate film element structures having different material types including different layer combinations have been tested without success. Consumer panel tests prove that containers with stronger film elements could not be opened as consumers did not have the sufficient strength to break the film element.

SUMMARY OF THE INVENTION

Accordingly, it is an object of the present invention to obviate the above-noted shortcomings & disadvantages related to containers known in the prior art.

It is another objective of the present invention to provide a container which will be more economical.

It is another objective of the present invention to provide a container which will preserve the environment in a better way.

It is another objective of the present invention to provide a container which will reduce consumption of natural resources.

It is another objective of the present invention to provide a container which will be easier to use for the consumers.

DESCRIPTION OF THE PREFERRED EMBODIMENT

Figure 1:
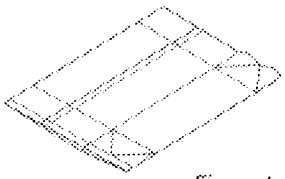
FIG. 1 is an isometric view of a container blank folded to a sleeve including creasing lines and the $5^{th}$ panel heat sealed.
Figure 2:
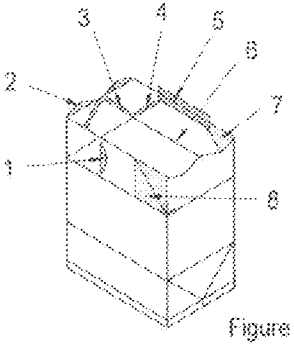
FIG. 2 is an isometric view of the opened container sleeve including heat sealing areas and a film strip, before folded, compressed and sealed.
Figure 3:
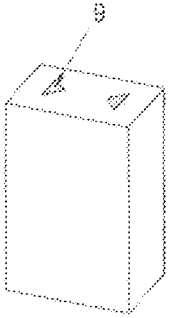
FIG. 3 is an isometric view of the mandrel with two raised triangular sealing elements.
Figure 4:
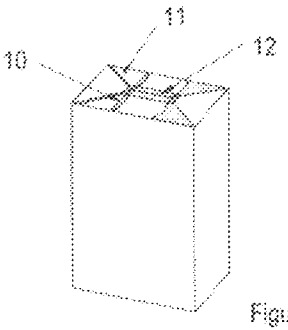
FIG. 4 is an isometric view with a transparent top view, showing the closure sealing areas including the film strip.
Figure 5:
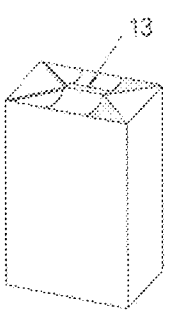
FIG. 5 is an isometric view with a transparent top view, showing the closure sealing areas with one mid closure longer panel edge overlapping second mid closure longer panel edge.
Figure 6:
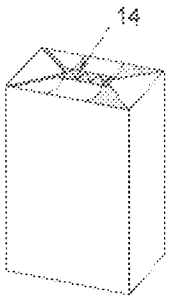
FIG. 6 is an isometric view with a transparent top view, showing the closure sealing areas with the film strip overlapping both interlocking paper board closure panel edges of the mid closures two longer panels.
Figure 7:
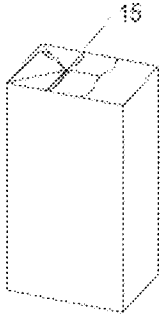
FIG. 7 is an isometric view of first opening stage of the closure with one pour spout panel side opened.
Figure 8:
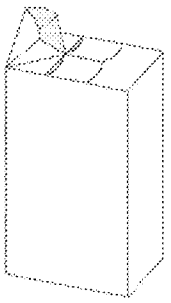
FIG. 8 is an isometric view of the container with the pour spout opened.
Figure 9:
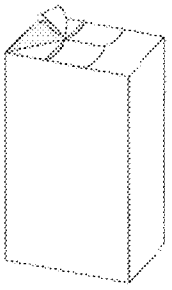
FIG. 9 is an isometric view of the container reclosed with the pour spout panel folded back and the closure resealed air tight.

According to FIG. 2 is an isometric view of the opened paper board sleeve before folded and heat sealed with a part of both sides Polyethylene (PE) coated aluminum strip 5 heat sealed inside fourth panel face with a part of both sides Polyethylene (PE) coated aluminum strip 5, protruding same fourth face. Sealing sections 3 and 4 from third and second faces are activated by hot air and when folded together and compressed, becoming one solid sealed section 11 according to FIG. 4. Sealing sections 1 and 2 from first and third faces are activated by hot air and when folded and compressed, becoming one solid sealing section 10 according to FIG. 4, Second face sealing section 4 has an in depth inside interrupted scoring line and when opening the container closure, paper board section 4 delaminate and is torn off against and between the 180° folded paper board edge and section 4 in depth interrupted scoring line with paper board section 4 attached to area 3 of third face, and simultaneously first face sealing section 1 in depth inside interrupted scoring line delaminate, and attach to area 2 of face three. FIG. 2 ref. #6 is closures lower limitation surrounding folding line, ref. #7 is inside closure heat sealing area and ref. #8 is outside closure heat sealing areas. Ref. #9 according to FIG. 3 is a mandrel design with two raised triangular sealing panels oriented in the mid closures area. According to FIG. 4 is an isometric view with a transparent top view of sealing areas #11 and #12 of the container closure with polyethylene (PE) coated aluminum strip 12 heat sealed and providing third and fourth inside paper board face edge center areas with an air and liquid proof seal. According to FIG. 5, third face edge 13 overlapped by fourth face edge seal, is an alternative. The extended mid closure area could alternatively be closed by a film strip, sealing & overlapping third and fourth paper board panels interlocking edges (any interlocking edge profiles is possible) according to FIG. 6 area 14.

Hot air is blown through a nozzle/manifold having designated heat activating sections inside and outside the rectangular paper board sleeve closure area, before the closure is folded and compressed. Both sides polyethylene (PE) coated paper board is normally used, but also one side polyethylene (PE) coated paperboard could be used in combination with a hot melt polymer liquid sealant. When using a multi-polymer-laminate including aluminum foil, induction sealing could eventually be considered. Ultra Sonic sealing is a third option that eventually also could be considered. By using plain paper board without polymer coating, hot melt is used and for sealing the entire carton. For an aseptic carton version, skiving and hemming of the $5^{th}$ panel is required.

The present invention should not be considered limited to the particular examples described above, but rather should be understood to cover all aspects equivalent methods, as well as numerous structures to which the present invention may be applicable, will be readily apparent to those of skill in the art to which the present invention is directed upon review of the instant specification.

The invention claimed is:

1. A closure on a rectangular container comprising:

at least one panel wall coated with a heat sealable polymer film layer, said wall including a first pair of opposite side walls and a second pair of opposite side walls, said wall connected along a single joint for storing pourable consumer products, a closure formed by four faces, a first and a second of said four faces connected to said first pair of opposite side walls along respective first and second fold lines, a third and a fourth of said four faces connected to said second pair of opposite side walls along respective third and fourth fold lines;

each of said first and second faces including a diagonal fold line extending from an end of a respective one of the first and second fold lines to a free edge of the respective first and second faces, said third face including diagonal scoring lines extending from meeting points of the first and third folding lines and the second and third folding lines, respectively to a free edge of the third face, said third face including face section parts;

said first and second faces folded inwardly such that the first and second free edges of the first and second faces meet edge to edge at a closure center line, said fourth face is folded over part of the first and second faces and connected thereto by a permanent seal, said third face is connected to the first and second faces by heat sealing with inside sections of said third face being heat sealed onto outwardly folded sections of the first and second faces and with said face section parts secured to the first and second faces, respectively;

whereby, when opening the closure, said diagonal scoring lines delaminate and the face section parts are torn and separated from the third face to allow separation of the third face from the first and second faces and formation of a pouring opening partially defined by the outwardly folded sections and the inside sections.

2. The closure on a rectangular container of claim 1 wherein at least one of said scoring lines provides a tearing path.

3. The closure on a rectangular container of claim 2 wherein said tearing path provides for opening said rectangular container.

* * * * *